United States Patent [19]

Lovibond

[11] 4,389,011

[45] Jun. 21, 1983

[54] STITCHING MACHINE

[75] Inventor: Michael J. Lovibond, Kimpton, England

[73] Assignee: Xerox Corporation, Stamford, Conn.

[21] Appl. No.: 106,198

[22] Filed: Dec. 21, 1979

[30] Foreign Application Priority Data

Dec. 29, 1978 [GB] United Kingdom ..... 50325/78

[51] Int. Cl.[3] ..... B27F 7/21; B27F 7/23

[52] U.S. Cl. ..... 227/5; 227/84; 83/205

[58] Field of Search ..... 227/3, 4, 5, 6, 7, 84, 227/85, 88, 152, 155, 90; 83/205

[56] References Cited

U.S. PATENT DOCUMENTS

| | | | |
|---|---|---|---|
| Re. 5,696 | 12/1873 | Blake et al. | 227/5 |
| Re. 13,967 | 8/1915 | Juengst | 227/84 |
| 1,048,134 | 12/1912 | Casgrain | 227/5 |
| 1,450,164 | 4/1923 | Bates | 227/5 |
| 3,690,537 | 9/1972 | Turner et al. | 227/88 |
| 3,753,523 | 8/1973 | Perlman | 227/88 |

FOREIGN PATENT DOCUMENTS

| | | |
|---|---|---|
| 651636 | 2/1929 | France . |
| 324682 | 2/1930 | United Kingdom . |
| 692106 | 5/1953 | United Kingdom . |
| 781017 | 8/1957 | United Kingdom . |

*Primary Examiner*—Paul A. Bell

*Attorney, Agent, or Firm*—Bernard A. Chiama

[57] ABSTRACT

A wire stitcher includes a cutter for cutting a length of wire W from a supply thereof and a stitcher head having a former and driver for forming and driving the length of cut wire for binding a set SS of sheets. The length of cut wire which is presented to the head by a wire advancing and cutting mechanism is automatically determined in dependence upon the thickness of the set SS. The mechanism includes a movable gripper block which advances the wire and the cutter is carried on a movable cutter block. The gripper block and the cutter block are biased towards each other by a spring and driven by a common drive cam.

12 Claims, 11 Drawing Figures

Figure 1:
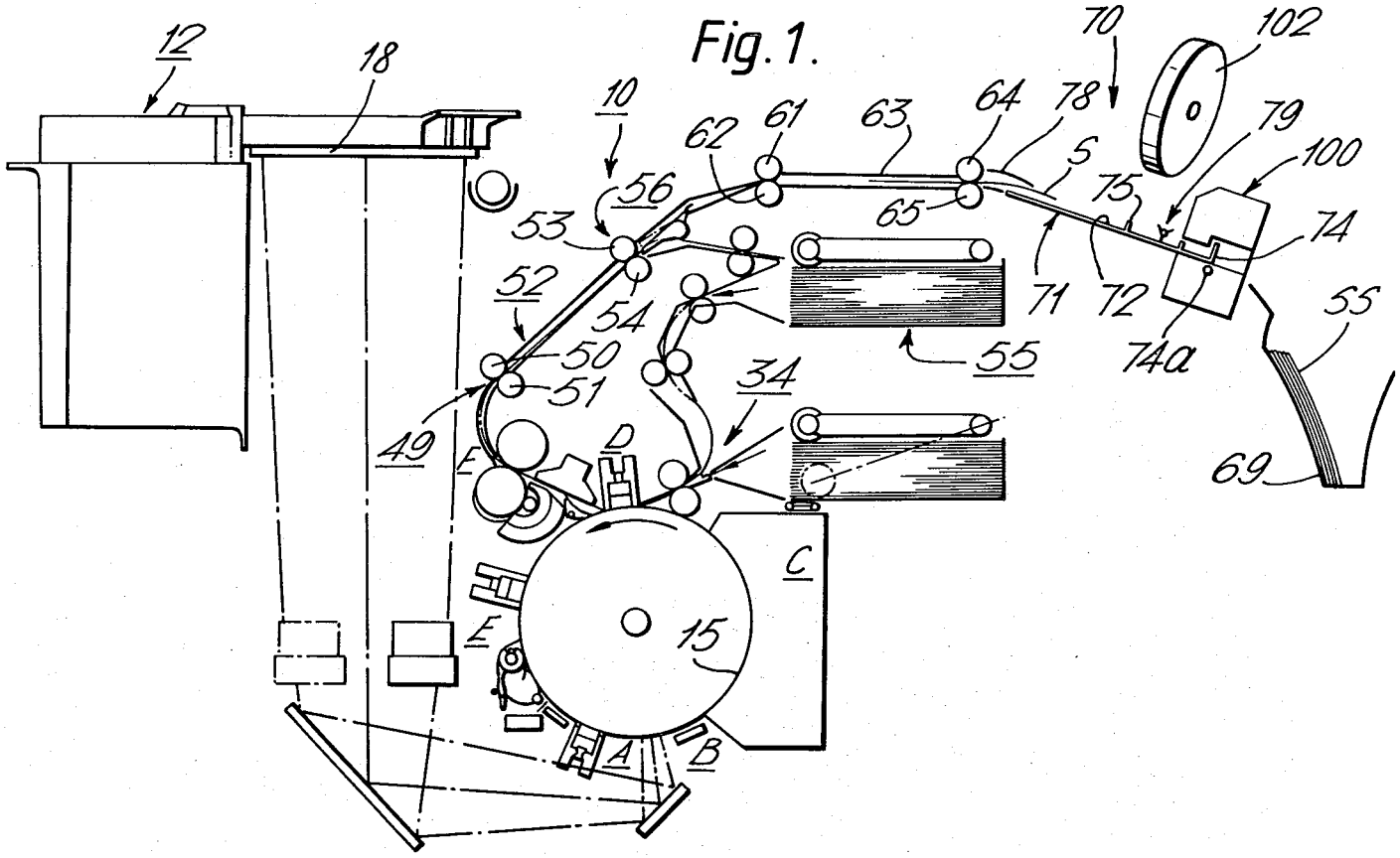

105
106
105
107
108
104
W
104a

120
W
103
123
120
122
124
55
106
109
125
121
138
139
202
206
210
205
205
204
105
110
104
101
203
208
201
207
209
217

107'
190
173
105'
170
106'
104'
104a'
72
124'
149
144
145
74
143
201'
202'
146
206'
148
147
205'
211'
253
213
207'
255
254
270
209'
252
219
219a
251
218
250

STITCHING MACHINE

This invention relates to wire stitchers and particularly to such apparatus for binding sets or signatures of sheets or documents. Stitchers take various well-known forms. There are those (called staplers) which use preformed staples, those using pre-cut lengths of wire which are formed in the machine and those in which the staples are formed from a continuous wire wound on a spool from which pieces are cut and formed in the machine. In each case the legs of the formed staple or stitch are driven through the set until the crown of the staple lies against one face of the set and the ends of the staple legs are bent over against the opposite face of the set to form clinches. The present invention is concerned with stitchers of the kind in which the staples are formed from wire stock.

It will be understood that where the stitcher is capable of accommodating sets of varying thickness it is desirable to have some means of adjusting the length of wire used for forming the stitch and although it is possible to accommodate varying set thicknesses by permitting the clinches to vary according to the thickness of the set, even to the extent in some cases of angling the clinches so that they overlap for very thin sets, this imposes limits on the capacity of the machine and is also aesthetically undesirable. In order to avoid this, machines are available in which the length of wire cut to form the stitch may be varied, but in order to achieve such variation it has been necessary to stop the machine in order to perform an accurate and usually intricate manual adjustment requiring a skilled operator. Such a procedure is acceptable where long runs of identical sets or signatures are being produced such as occurs in the printing industry (e.g. saddle stitching magazines) but does not provide a solution in the case where frequent and often substantial variations in set thickness occurs such as in a finisher receiving sets from an office copier or duplicator.

A solution to this problem is set forth in our copending Application No. 106,423 filed concurrently herewith wherein there is described and claimed a stitcher in which a piece of wire is cut from a supply of wire and formed and driven through a set of sheets to bind the sheets together, wherein the length of said piece of wire is determined automatically in dependence on the thickness of said set of sheets.

The present invention provides a wire stitcher including a cutter for cutting a length of wire from a supply thereof and a stitcher head for forming and driving the length of cut wire for binding a set of sheets, in which the cutter is movable and the length of cut wire presented to the stitching head is automatically determined by advancing the wire by gripper means by a distance dependent upon the thickness of the set and positioning the cutter in dependence upon the thickness of the set, movement of the gripper means and the cutter being limited by inhibitor means positioned in dependence upon set thickness, wherein the gripper means and the cutter are biassed towards each other and are driven by a common drive member. The drive member suitably takes the form of a cam having opposite faces acting on the gripper means and the cutter respectively.

Preferably, the wire is advanced past a normal or rest position of the cutter by a distance made up of a constant (crown length plus twice clinch length) plus the set thickness and the cutter is retracted from the rest position by a distance equal to the set thickness. However, given that there will be a minimum set thickness (two sheets) the constant may instead include twice the minimum set thickness in which case the cutter will be retracted, in all cases except for a minimum thickness set, by the set thickness minus the minimum set thickness. This latter arrangement avoids the need to move the cutter when binding minimum thickness sets. In each case a cut wire of the required length is obtained which is automatically centred on the head.

The wire is conventionally fed to a stitcher head via a dancer which maintains a controlled tension in the wire and it is therefore necessary to arrange for the wire to be continuously gripped at the head. This is most conveniently achieved as described in our aforesaid application by means of wire diodes incorporated in the gripper device and a cutter member by each of which the wire is gripped only against relative movement in the direction opposite the wire advancing direction.

The stitcher may be incorporated in a sheet stitcher/compiler as part of a finisher for a photocopier and such a finisher may form part of the photocopier or take the form of a separate unit.

Figures 2, 3:
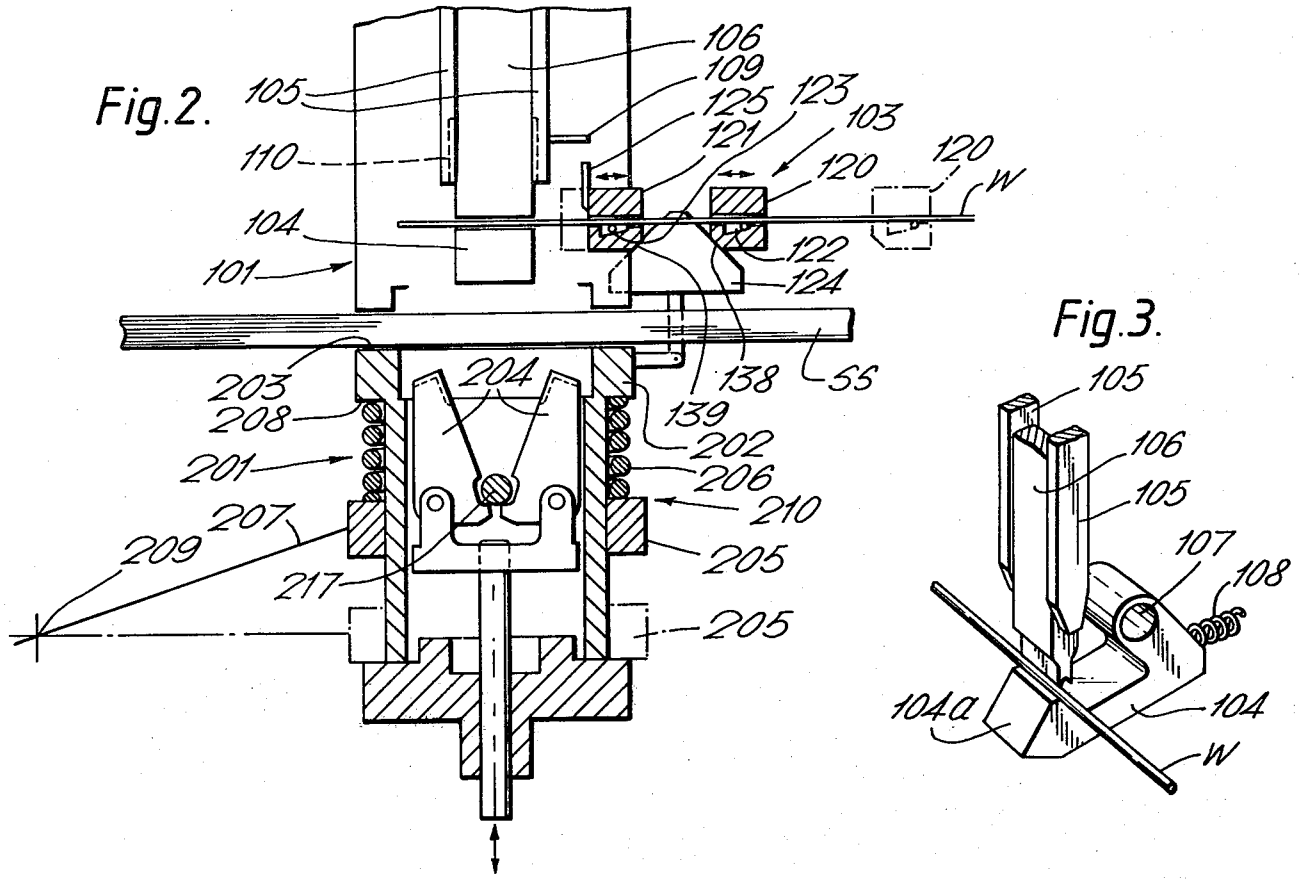
Figure 4:
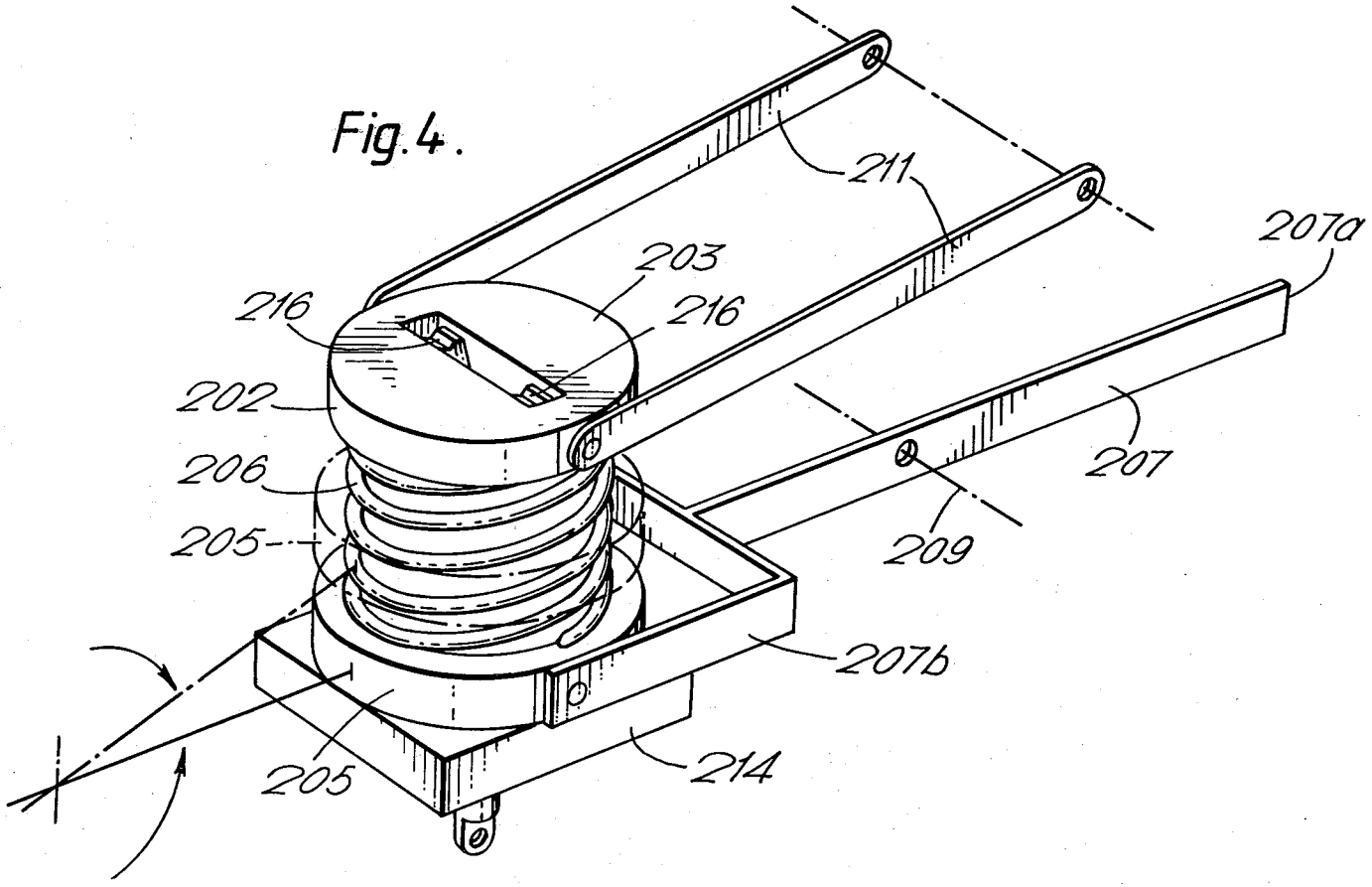
Figure 5:
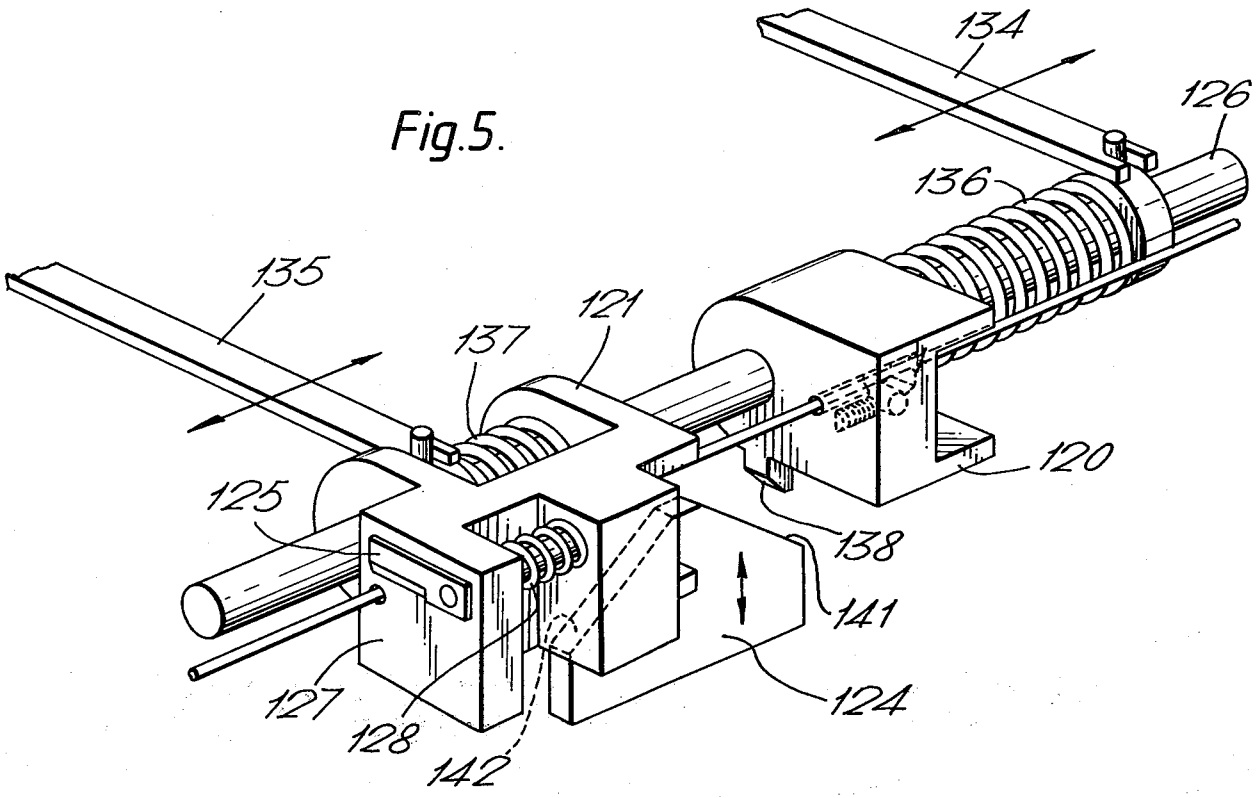
Figure 6:
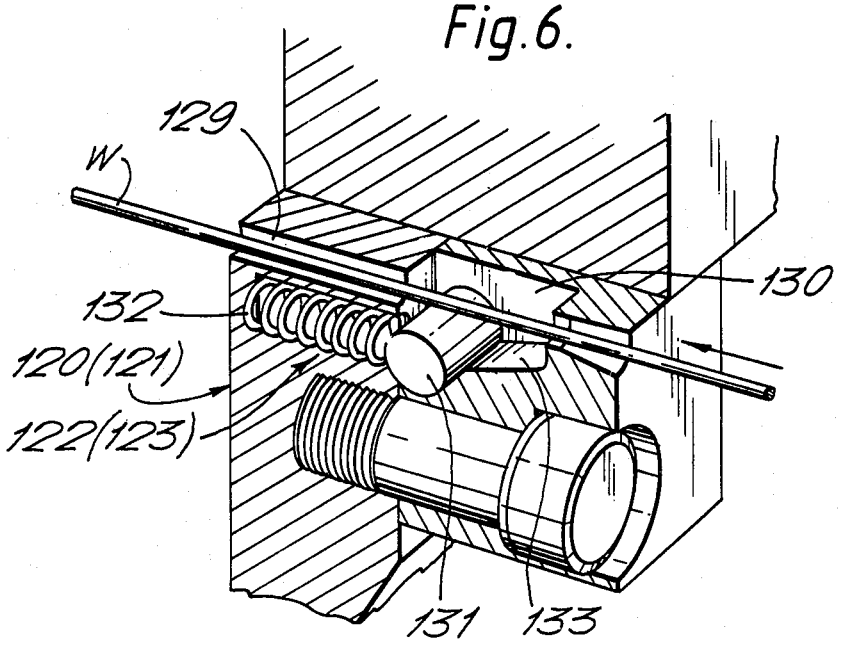
Figure 7:
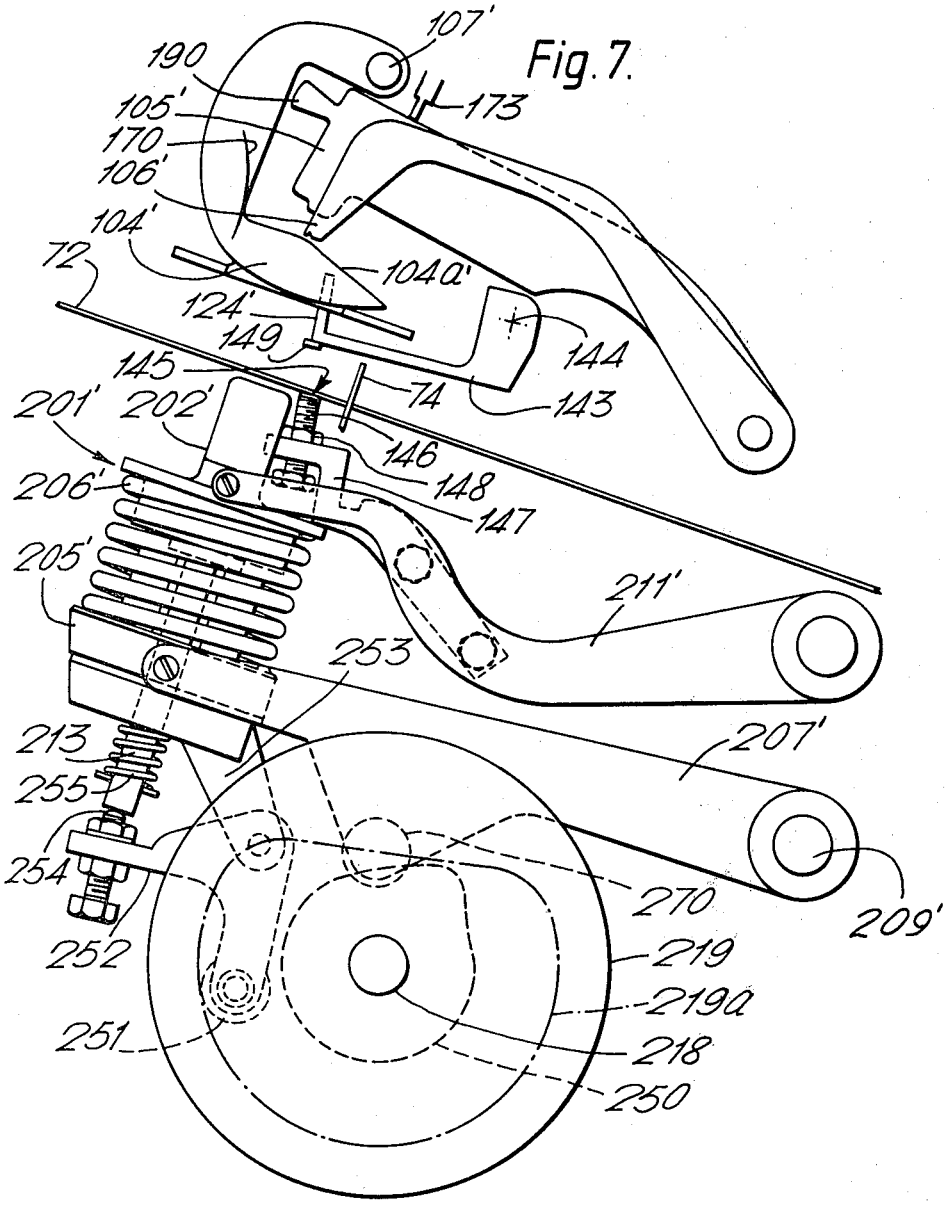
Figure 8:
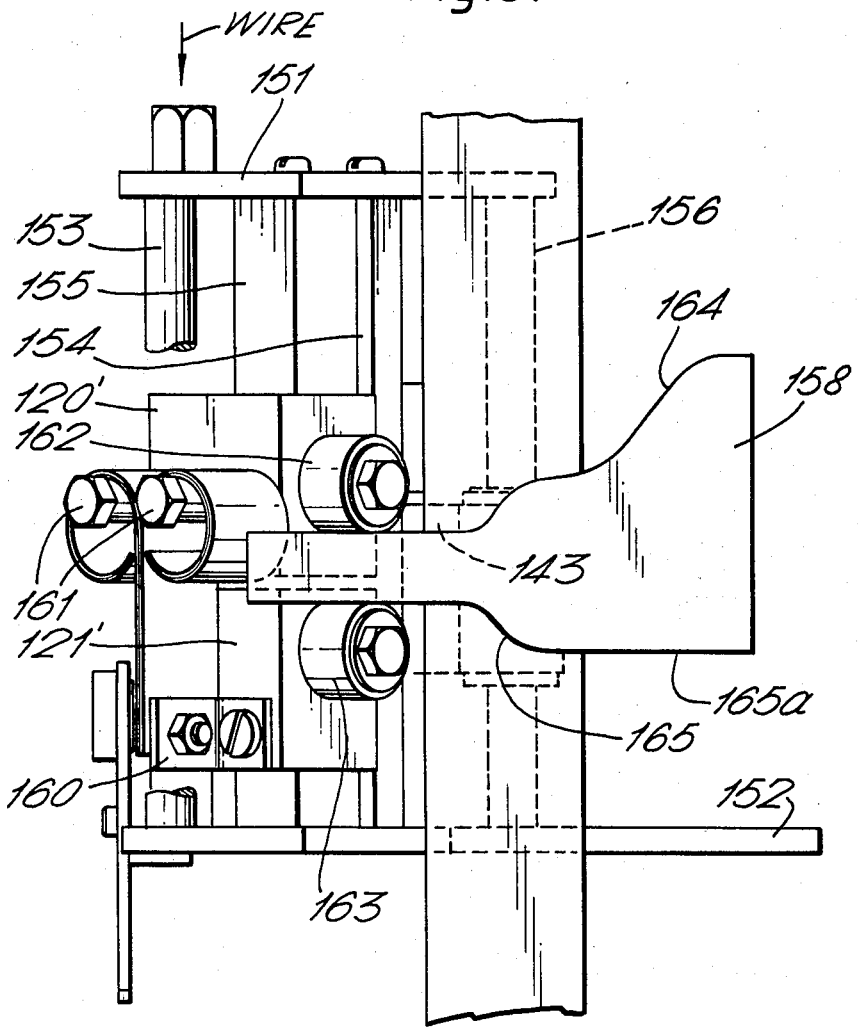

In order that the invention may be more readily understood, reference will now be made to the accompanying drawings in which:

FIG. 1 is a schematic side elevation of an exemplary form of photocopier having a finisher incorporating a stitcher according to this invention, FIG. 2 is a schematic view illustrating the principles of one embodiment of stitcher according to our aforesaid copending application no. 106,423, noted above, FIG. 3 is a scrap view of the stitcher shown in FIG. 2 illustrating schematically the relationship of various of its major parts, FIG. 4 is a schematic perspective view of the clincher showing the drive therefor, FIG. 5 is a perspective view of the mechanism for feeding wire to the stitcher, FIG. 6 is a sectional view illustrating a preferred form of wire diode for use in the wire feeder of FIG. 4, FIG. 7 is a side elevation of an embodiment of stitcher according to the present invention suitable for use in the machine shown in FIG. 1, FIG. 8 is a view from above looking in the direction of arrow VIII of the wire advancing and cutting mechanism of the stitcher shown in FIG. 7.

Figure 9:
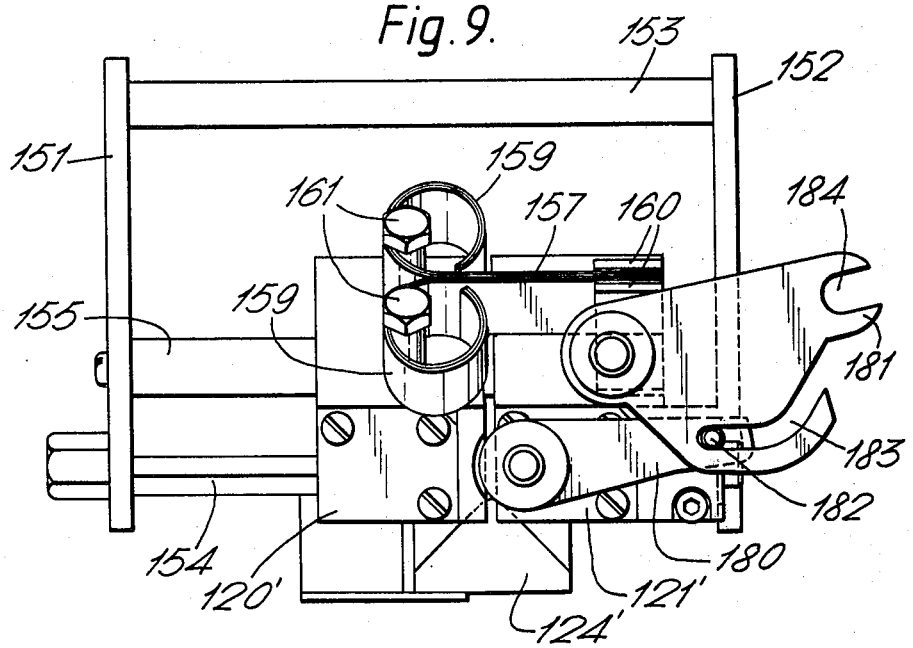
Figure 10:
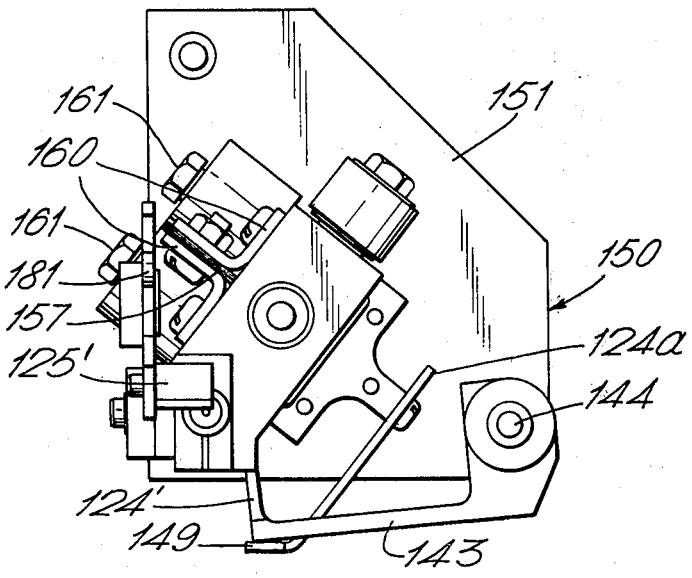
Figure 11:
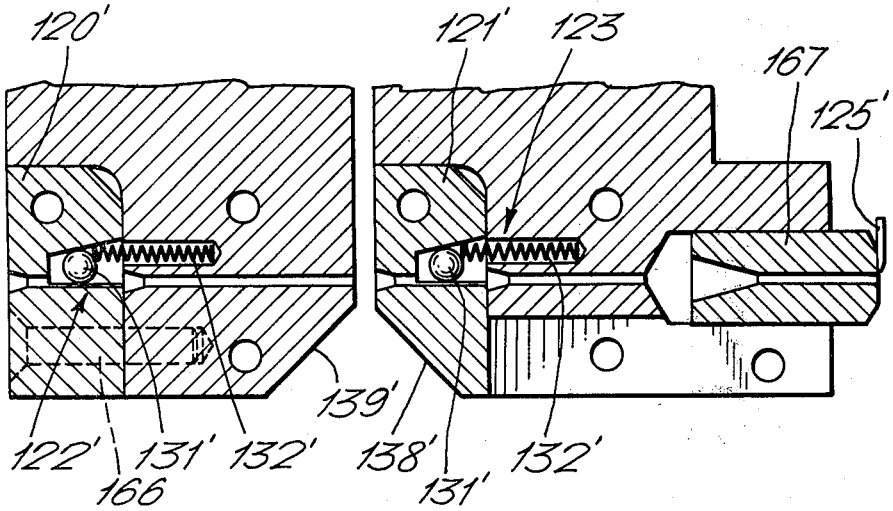

FIG. 9 is a side elevation of the wire advancing and cutting mechanism of FIG. 8, FIG. 10 is an end elevation of the wire advancing and cutting mechanism of FIG. 8, and FIG. 11 is a partial section through the wire advancing and cutting mechanism of FIG. 8.

Referring to FIG. 1 there is shown an automatic xerographic reproducing machine 10 having a finisher 70 incorporating a stitcher 100 according to this invention. The copying machine 10 is capable of producing either simplex or duplex copies in sets from a wide variety of originals which may be advanced in recirculating fashion by recirculating document apparatus 12 described in U.S. Patent No. 3,556,512. Although the present invention is particularly well suited for use in automatic xerography, the apparatus generally designated 100 is equally well adapted for use with any number of devices in which cut sheets of material are delivered or compiled in a set or stack.

The processor 10 includes a photosensitive drum 15 which is rotated in the direction indicated so as to pass sequentially through a series of xerographic processing stations: a charging station A, an imaging station B, a developer station C, a transfer station D and a cleaning station E.

A document to be reproduced is transported by document handling apparatus 12 from the bottom of a stack to a platen 18 and scanned by means of a moving optical scanning system to produce a flowing light image on the drum at B. Cut sheets of paper are moved into the transfer station D from sheet registering apparatus 34 in synchronous relation with the image on the drum surface. The copy sheet is stripped from the drum surface and directed to a fusing station F. Upon leaving the fuser, the fixed copy sheet is passed through a curvilinear sheet guide system, generally referred to as 49, incorporating advancing rolls 50 and 51. The advancing rolls forward the sheet through a linear sheet guide system 52 and to a second pair of advancing rollers 53 and 54. At this point, depending on whether simplex or duplex copies are desired, the simplex copy sheet is either forwarded directly to the finisher 70 via pinch rolls 61, 62 or into upper supply tray 55 by means of a movable sheet guide 56 before the finishing apparatus for the duplexed copy. Movable sheet guide 56, and associated advancing rolls are prepositioned by appropriate machine logic system to direct the individual sheets into the desired path.

The finisher 70 comprises a tray 71 having a base or support surface 72 inclined downwardly in the direction of sheet travel towards a registration corner defined by registration fences 74,75 extending along the lower edge and one side of the tray. Above the upper end of the support surface is arranged a pair of coacting sheet feed rolls 64, 65 arranged to receive sheets fed along path 63 by pinch rolls 61, 62. From the feed rolls 64, 65, a sheet is directed by guide throat 78 towards the tray 71. A corner registration device 79 such as a paddle wheel like that described in U.S. Patent No. 3669447 is arranged over the surface 72 to urge the sheets S into the registration corner to position them for receiving a stitch from the apparatus 100. The registration fence 74 is rotatable about an axis **74*a* so that it may be retracted for ejection of bound sets SS into a collection tray 69**. Any suitable ejection mechanism, such as drive rollers, may be employed.

Referring now to FIGS. 2 and 3 of the drawings, the stitcher 100 comprises a stitcher head 101, a reel 102 (FIG. 1) from which wire W is supplied via a dancer (not shown) to the head 101 and an active clincher 201. The head 101 includes a wire advancing and cutting mechanism generally indicated at 103 for presenting lengths of cut wire to the stitcher head, an anvil 104 for supporting the wire, a former 105 including two elements at opposite sides respectively of the driver for forming the wire into a generally U-shape about the anvil and a driver 106 for driving the formed staple through the set SS. The clincher 201 comprises a clincher housing 202 having a clamping surface 203 by which a set SS may be clamped against the underside of the stitcher head 101 and containing clinch ears 204 arranged to receive and act upon staple legs driven through the set and into the housing through a slot in the surface 203.

In FIG. 2, the clincher 201 is shown in its operative position with a set SS positioned against the head 101 which is fixed in position above the compiler tray. It will be understood, however, that during compilation of the set, the clincher is lowered so that the clamping surface 203 is below the support surface 72 of tray 71. During a stitching operation the clincher 201 is raised to lift the set SS against the underside of the head 101 and clamp it in position. Variations in set thickness are accommodated by the drive mechanism 210 by which the clincher housing is raised to lift the set against the underside of the stitcher head and clamp it into position to receive a stitch. This mechanism comprises a force applying ring 205 which lifts the housing via a compression spring 206, being moved through a fixed distance by a lever 207 (see FIG. 4). The spring 206 is positioned between the force applying ring 205 and a shoulder 208 and the lever 207 which is arranged to pivot about axis 209 is actuated by a cam (not shown) which acts on its free end **207*a*. As shown in FIG. 4 the other end of the lever is bifurcated to form a yoke 207*b* which is pivotally connected to the force ring 205. The clincher housing 202 is supported and guided by a pair of arms 211 pivotally connected between the housing and the frame of the stitcher. The mechanism 210 in addition to accommodating varying set thicknesses, varies the clamping pressure applied to the set as a function of set thickness. Thus, the thinner the set the less the compression of spring 206 and the less the clamping force applied. The clincher ears 204 are positioned in fixed relation to the housing 202 so that they are always presented to the set in the same relation regardless of the set thickness. The wire advancing and cutting mechanism 103 comprises movable wire advancing and cutter blocks 120, 121 and an inhibitor member 124 positioned by the clincher 201 in dependence on the thickness of the set of sheets SS. The blocks 120, 121 include wire diodes 122, 123 which grip the wire only against movement relative to the respective block in the direction opposite the wire advancing direction. Thus, the diodes grip the wire when the blocks are moved to the left but allow each block to be moved to the right along the wire while the other block holds the wire. At the start of a wire feed cycle, the blocks 120 and 121 are positioned as shown in dotted lines in FIG. 2. To feed the wire W, the advancing block 120 is moved to the left, its diode 122 gripping the wire, to advance the wire past the rest or start-of-cycle position of the cutter 125 by a distance made up of a constant (crown length plus twice clinch length) plus the set thickness and the cutter block is retracted from its rest position by a distance equal to the set thickness. These movements and thus the length of wire W presented to the stitcher head 101 for severing by the cutter 125 are determined by the inhibitor member 124 which limits the movement of the blocks 120, 121, according to the thickness of the set. The blocks 120, 121 are shown in full lines in their final positions at the end of a wire advancing movement. As the mechanism recycles to its start position (which takes place at the end of the complete stitching cycle) the cutter block 121 returns to its rest position pulling the wire with it—so that the wire end is always in the same position at the start of a feed cycle -and the advancing block 120** traverses back along the wire to its rest position.

The wire advancing and cutting mechanism 103 is more fully illustrated in FIGS. 5 and 6 from which it will be seen that the advancing block 120 and the cutter block 121 are both mounted for horizontal sliding movement on a guide rail 126. In FIGS. 2, 5 and 6, the wire advancing direction is from right to left and the cutter 125 is pivotally mounted on the left-hand end 127 of the cutter block which forms a shear face. The cutter is actuated by a projection 109 on the former 105 as described below and is returned to its inactive position following an operating cycle by a tension spring 128. The blocks 120, 121 have bores 129 through which the wire W is threaded and which incorporate the wire diodes 122, 123. As best shown in FIG. 6 the diodes comprise a cavity 130 along the bore 129 which contains a roller 131 lightly loaded by a spring 132. The face 133 of the cavity opposite the bore is inclined so that the cavity tapers in the wire advancing direction and the spring 132 urges the roller into engagement with the wire. The block 120, 121 are respectively driven by levers 134, 135 through override springs 136, 137. The levers are driven by cams (not shown) through a fixed travel and the springs 136, 137 accommodate the variations in the travel of the blocks 120, 121 imposed by the inhibitor member 124. The latter is mounted for vertical sliding movement with the clincher housing 202 as schematically illustrated in FIG. 2. The inhibitor member 124 has two opposed 45° faces 141, 142 which are engaged by 45° faces 138, 139 respectively on the advancing block 120 and the cutter block 121. Using 45° faces, the relationship between the position of the clincher housing and the inhibitor 124 is linear and 1:1.

While the inhibitor member 124 may be directly connected to the clincher housing 202 as schematically represented in FIG. 2, other arrangements are possible. Thus in a second embodiment as shown in FIG. 7, the inhibitor member 124' is carried on an arm 143 pivoted to the stitcher head at 144 and is positioned by means of an actuator 145 mounted on one of the clincher housing guide arms 211'. As shown the actuator is adjustable for correctly setting the mechanism and comprises a bolt 146 threaded through a bracket 147 and locked into position by a nut 148. While the clincher is retracted, the inhibitor is supported by a limit stop 149.

The embodiment of FIG. 7 also includes a modified drive for the force ring 205' in which as a space-saving measure, the lever 207' carries a cam follower 270 intermediate the force ring 205' and pivot axis 209' which is controlled by a face cam 219 the centre-line of the guideway of which is shown by the dash-dot line **219*a*. The cam 270 is mounted on a cam shaft 218**.

The length of wire presented to the stitcher head 101 by the mechanism 103 is cut, formed and driven in the following manner. While the anvil 104', which is pivotally mounted at 107' and biassed to its start-of-cycle position by a spring 108 as shown in FIG. 3, is held against movement, the driver 106' is moved downwardly against the wire to clamp it in position on the anvil. The former elements 105' then start moving downwardly. Initial movement of the former operates the cutter 125 through actuator 109 to sever the required wire length and further movement thereof shapes the wire about the anvil 104' into a generally U-shape. In order to accommodate the wire during this operation, the formers have guide grooves 110 along their inner faces. At the end of the forming operation the former is in its lower limit position with the lower ends of the former elements 105' below the underside of the anvil 104' and adjacent the set. The driver 106' is now driven downwardly, pivoting the anvil about its axis 107', to drive the formed staple. As seen in FIG. 3, the anvil includes a sloping surface **104*a'*. During the driving operation, the anvil surface 104*a'* forms a support for the crown of the staple. Similarly the former elements serve to support the legs of the staple in the grooves 110** during the driving movement.

It will be realised from the foregoing that the anvil must be held against movement during the cutting and forming stage but be pushed out of the way during the driving stage. This may be achieved by using a spring 108 which is strong enough to hold the anvil stationary during cutting and forming. However, this requires that the force available to drive the driver must be sufficient also to overcome the resistance of the spring. It is preferred therefore that as described with reference to our copending Application No. 106,324, now abandoned filed concurrently herewith, the anvil be held locked in position during the cutting and forming stage and released by the former 105' at the end of its travel whereby only a relatively light spring 108 is required which is sufficient to return the anvil to its start-of-cycle position and to ensure that the anvil supports the staple crown during the driving stage. One way of achieving this is shown in FIG. 7 in which the anvil is geometrically locked in position during the cutting and forming steps by arranging the pivot axis 107' above the line of pressure engagement between driver and anvil, the lock being released by a projection 190 on the former engaging an actuator surface 170 on the anvil support area.

As described above, the stitcher has a two stage driver action in which following wire feed a first stage motion operates to grip the wire W against the anvil 104' during cutting and forming and a second stage motion acts following forming to effect driving of the formed staple. A mechanism suitable for this operation based on pivoted motions which first holds the wire against the anvil and then provides the driving motion all from one continuous input lever travel is described in our copending Application No. 106,193 filed concurrently herewith.

The ends of the staple legs are turned over and wiped flat against the underside of the set by the clincher ears 204. The clincher 201' is operated as described more fully in our copending Application No. 106,197 filed concurrently herewith so that the staple legs having passed through the set move through air and meet no further resistance during driver travel. This is achieved by arranging the clincher ears out of the paths of the staple legs during driver travel so that leg wander is accommodated wholly within the clinch ears by profiling the ears with a groove wide enough to accommodate the maximum leg wander anticipated. The drive to the clincer ears may be by a spring which is loaded during return motion of the clincher housing at the completion of a stitching operation as more fully described in our copending Application No. 106,193 filed concurrently herewith, the clinch ears being held latched in the position shown in FIG. 2 prior to the operation thereof, or by a cam drive 250 as illustrated in FIG. 7 where the clincher rod 213 is driven by an edge or ramp cam 250 mounted on the same drive shaft 218 as, and alongside, the cam 219 which drives the force-ring lever 207'. The drive to the clincher rod from the cam 250 is effected by a roller follower 251 mounted on one end of a crank arm 252 pivoted to a bracket 253 depending outwardly from the clincher housing 202'. The other end of the crank arm carries a stop 254 which engages the bottom end of the clincher rod 213. As shown, the stop 254 is adjustable to permit setting of the clincher ear movement. The clincher ears 204 are biassed to their open, retracted position by a spring schematically represented at 255. The cam shaft 218 is driven in synchronism with the head 101 drive and the cam 250 is disposed so that the clincher rod is driven only after the formed staple has been completely driven through the set. It will be noted that by using a drive arrangement as shown with the face cam 250, variations in set thickness are accommodated without affecting the timing (except to an insignificant degree caused by slight variations in the position of the cam follower 251 to cam 250) of the clincher ear movement relative to that of the driver.

An embodiment of wire advancing and cutting mechanism of a stitcher of this invention is shown in FIGS. 8 to 11 in which as noted above the inhibitor member 124' is pivoted to stitcher head at 144 and positioned by an actuator 145 seen in FIG. 7. More specifically it will be seen that the inhibitor member is pivoted to a frame 150 of the stitcher which like the head 101 is fixed. The frame includes end plates 151, 152 (the latter being omitted in FIG. 10 for clarity) and cross bars 153—156 of which bars 154, 155 act as rails for the wire advancing and cutter blocks 120', 121' and bar 156 carries the pivot 144 for inhibitor member 124'.

The wire advancing and cutter blocks 120', 121' are permanently biassed together by spring mechanism 157 and driven apart by a double-face cam 158 during positioning of the inhibitor member 124'. The spring mechanism 157 best comprises tensator springs 159 of which a pair are used. The springs 159, which are each of three layers of spring steel 0.15 mm thick, are secured at one end between brackets 160 mounted on the cutter block 121' and at the other end wrap around posts 161 on the wire advancing block 120'. The blocks 120', 121' carry cam followers 162, 163 which act respectively on the opposite faces 164, 165 of the cam 158. As will be seen, the cam 158 is asymmetric in view of the greater variation in movement required of the wire advancing block 120' compared with the cutter block 121'.

In FIGS. 8 to 11 the wire advancing and cutter blocks are shown in their closest position (corresponding to the longest length of wire which can be fed) in which the inhibitor member 124' touches the blocks 120', 121' but does not spread them beyond the minimum spacing effected by the narrowest portion of cam 158. In their start-of-cycle positions prior to the feeding of a wire length, the blocks 120', 121' are fully spread apart with the followers 162, 163 on the widest portion of the cam 158. As will be noted by reference to FIG. 11 in which the wire is fed from left to right, as the blocks are separated, the cutter block (diode 123' locked) carries the wire to the right as the advancing block (diode 122 free) runs along the wire to the left. As the blocks return together, the advancing block (diode 122' locked) pushes the wire through the cutter block (diode 123' free) which—see cam profile in FIG. 8—initially remains stationary. During the final movement of cam 158 to the position shown in FIG. 11, the cutter block is retracted (diode 123' still running free) back to the position shown while the advancing block (diode 122' still locked) finalises its return movement. For shorter lengths of wire these return movements of the blocks 120', 121' are limited by the inhibitor 124'. The cam profile is chosen so that the portion **165*a* of cutter block acutating face 165** corresponds to the position of the cutter for the wire length required for a minimum thickness set. This not only ensures that for a minimum thickness set, the cutter block does not have to move but provides a ready means of accurately setting the inhibitor.

As shown in FIGS. 9 and 10 the limit stop 149 for the inhibitor 124' is carried by an arm **124*a* secured to the frame 150**.

Referring to FIG. 11, the advancing and cutter blocks 120', 121' are each constructed in two parts bolted together, as by bolt 166 and the cutter block 121' includes an adjustable shear member 167. The cutter 125' is carried at the end of a pivotally mounted arm 180 and is driven by pivot plate 181 via a pin 182 on the arm 180 engaging in a slot 183 in plate 181. The plate 181 is itself driven by projection 190 (see FIG. 7) on the former which engages in a recess 184 in the plate 181. Whilst specific embodiments of the invention have been described above it will be understood that various modifications may be made to the specific details referred to herein without departing from the scope of the invention is defined in the appended claims. Thus, the principles of this invention although described in relation to a flat bed stitcher may equally be applied to a saddle stitcher.

Further, while in the apparatus described above the stitcher is fixed in position, it may be movable for varying the position of the stitch or for inserting more than one stitch in a set. Also, two or more stitchers according to the invention, which may themselves be movable, may be operated in tandem, in which case various of the drive elements may be common to avoid duplication.

It will also be understood that while in the embodiments described, the stitcher head is fixed, the clincher could be fixed and the clamping means be formed by the sheet receiving surface of the head itself.

It will further be understood that although the embodiments of stitcher described and illustrated show the stitcher head above the clincher, the stitcher may be arranged in any suitable orientation and specifically the clincher may be arranged over the stitcher head.

For clarity, it is to be noted that the term staple is used herein to mean either a wire-fastener which is pre-formed outside the stitching machine or one which is formed within the machine.

The ends of the staple or stitch legs may be turned over by an active clincher including ears which are wiped against the leg ends as described above or by a passive clincher having fixed guide surfaces. The advantage of an active clincher is that the legs are wiped flat against the set.

Although in the embodiments described herein, the constant by which the wire is advanced is either crown length plus twice clinch length or crown length plus twice clinch length plus a minimum set thickness, it will be understood that various other permutations are possible. For example, the constant may equal crown length plus once clinch length in which case the cutter will include a clinch length. Furthermore, the cut wire length may be varied so as to produce a constant clinch size regardless of set thickness or the clinch size may be variable as a function of set thickness, being longer for thicker sets.

What is claimed is:

1. A wire stitcher having a movable cutter for cutting a length of wire from a supply thereof and stitcher head for forming and driving the length of cut wire for binding a set of sheets, the improvement including gripper means adapted to present the wire to the stitching head and to advance the wire by a distance dependent upon the thickness of the set, means for positioning the cutter in accordance with the thickness of the set, said movement of said gripper means and said cutter being limited by inhibitor means positioned in accordance with the set thickness, means for biasing said gripper means and said cutter towards each other, and a common drive member for driving said gripper means and said cutter.

2. A stitcher according to claim 1 in which the gripper means and the cutter are driven by a cam having opposite faces acting on the gripper means and the cutter respectively.

3. A stitcher according to claim 1 in which the cutter has a rest position and the end of the wire supply is advanced past the rest position of the cutter by a distance dependent upon the set thickness and the cutter is retracted along the wire by a distance dependent upon the set thickness.

4. A stitcher according to claim 1 in which the cutter has a rest position and the end of the wire supply is advanced past the rest position of the cutter by a predetermined distance plus the set thickness and the cutter is retracted along the wire from its rest position by a distance equal to the set thickness minus a minimum set thickness.

5. A stitcher according to claim 1 in which the cutter has a rest position and the end of the wire supply is advanced past the rest position of the cutter by a predetermined distance plus the set thickness and the cutter is retracted from its rest position by a distance equal to the set thickness.

6. A stitcher according to claim 1 in which wire diodes are associated respectively with the gripper means and the cutter which grip the wire only against relative movement to the respective one of the gripper means and the cutter in the direction opposite the wire advancing direction.

7. A stitcher according to claim 6 in which the wire diodes are each formed in a block bored to receive the wire, each bore including a cavity, the face of which opposite the wire path is inclined to the wire path and a spring loaded roller bearing runs on the face.

8. A wire stitcher having a movable cutter for cutting a length of wire from a supply thereof and stitcher head for forming and driving the length of cut wire for binding a set of sheets, the improvement including gripper means adapted to present the wire to the stitching head and to advance the wire by a distance dependent upon the thickness of the set, means for positioning the cutter in accordance with the thickness of the set, said movement of said gripper means and said cutter being limited by inhibitor means positioned in accordance with the set thickness, means for biasing said gripper means and said cutter towards each other, and a common drive member for driving said gripper means and said cutter, said gripper means and said cutter being driven by a cam having opposite faces acting on said gripper means and said cutter respectively.

9. A stitcher according to claim 8 in which the inhibitor means is positioned by movable clamping means arranged opposite the stitcher head for positioning of a set of sheets against the stitcher head.

10. A stitcher according to claim 9 in which the clamping means incorporates an active clincher.

11. A stitcher according to claim 9 in which the gripper means and the cutter have faces which engage with corresponding faces respectively of the inhibitor means which is moved in a plane at right angles to the plane of movement of the cutter and gripper means.

12. A stitcher according to claim 8 in which the inhibitor means is positioned by movement of the clamping means relative to a fixed stitcher head by which a set is positioned against the head.

* * * * *